US006733354B1

(12) United States Patent
Cathey et al.

(10) Patent No.: US 6,733,354 B1
(45) Date of Patent: May 11, 2004

(54) SPACERS FOR FIELD EMISSION DISPLAYS

(75) Inventors: David A. Cathey, Boise, ID (US); James J. Alwan, Ramona, CA (US)

(73) Assignee: Micron Technology, Inc., Boise, ID (US)

( * ) Notice: Subject to any disclaimer, the term of this patent is extended or adjusted under 35 U.S.C. 154(b) by 142 days.

(21) Appl. No.: 09/652,630

(22) Filed: Aug. 31, 2000

(Under 37 CFR 1.47)

(51) Int. Cl.[7] ..... H01J 9/02
(52) U.S. Cl. ..... 445/24; 445/50
(58) Field of Search ..... 445/24, 50; 313/422

(56) References Cited

U.S. PATENT DOCUMENTS

| | | | | |
|---|---|---|---|---|
| 5,063,327 A | * | 11/1991 | Brodie et al. | 313/482 |
| 5,242,647 A | | 9/1993 | Poco | |
| 5,275,796 A | | 1/1994 | Tillotson et al. | |
| 5,371,433 A | * | 12/1994 | Horne et al. | 313/495 |
| 5,486,126 A | | 1/1996 | Cathey et al. | 445/25 |
| 5,658,832 A | | 8/1997 | Bernhardt et al. | |
| 6,005,540 A | * | 12/1999 | Shinjo et al. | 313/309 |
| 6,353,280 B1 | * | 3/2002 | Shibata et al. | 313/495 |

FOREIGN PATENT DOCUMENTS

WO WO-90-00808 * 1/1990

OTHER PUBLICATIONS

Lorenz et al, *Sensors & Activators*, A64:33–39 (1998).
Lorenz et al, *J. Micromech. Microeng.*, 7:121–124 (1997).
Ulrich, *Chemtech*, pp. 242–249 (Apr. 1988).
Shoup, *Colloid Interface Science*, 3:63–69 (1976).
*Ultrastructure Processing of Ceramics, Glasses, and Composites*, Hench and Ulrich, eds., Wiley–Interscience Publication, pp. 70–87.
Guerin, L. J. et al., "SU–8 photoepoxy: A new material for FDP or PDP applications." Institute for Microsystems, Swiss Federal Institute of Technology, Switzerland, 53–54.
Despont, M. et al., "High–Aspect–Ratio, Ultrathick, Negative–Tone Near–UV Photoresist for MEMS Applications," Proc. of the 10$^{th}$ IEEE Int'l Workshop of Micro Electromechanical Systems (MEMS '97), Jan. 26–30, 1997, Nagoya, Japan.
Lee, K. Y. et al., "Micromachining applications of high resolution ultrathick photoresist," J. Vac. Sci. Technol. B. 13(6), Nov./Dec. 1995, pp. 3012–3016.
Lorenz, H. et al., "Mechanical Characterization of a New High–Aspect–Ratio Near UV–Photoresist," Swiss Federal Institute of Technology, Switzerland.

* cited by examiner

*Primary Examiner*—Kenneth J. Ramsey
(74) *Attorney, Agent, or Firm*—Hale and Dorr LLP

(57) ABSTRACT

The disclosed method for forming a field emission display includes forming a cathode and an anode, forming a plurality of photoresist posts over the cathode, and coating the posts with a coating material. The coating material forms sidewalls around the posts. The photoresist posts may then be removed from within the sidewalls. The anode may then be fitted onto the sidewalls so that the sidewalls function as spacers in the field emission display.

44 Claims, 5 Drawing Sheets

SPACERS FOR FIELD EMISSION DISPLAYS

The present invention was made with Government support under Contract No. DABT63-97-C-0001 awarded by the Department of Defense. The Government has certain rights in the invention.

BACKGROUND OF THE INVENTION

The present invention relates to improved spacers for use with field emission displays (FEDs). U.S. Pat. No. 5,063,327 discloses a prior art method of fabricating spacers for use in FEDs. However, as will be discussed below, the spacers disclosed by the '327 patent are not ideal and there remains a need for improved spacers and for methods of making such improved spacers.

Prior to discussing spacers, the general background of FEDs will be briefly reviewed. FIG. 1 shows a cross sectional view of a portion of a prior art FED 100. FED 100 includes a cathode, or baseplate, 102 and an anode, or faceplate, 104. Baseplate 102 includes a substrate 106, a plurality of field emitters 108, an insulating layer 110, and a conductive grid layer 112. Insulating layer 110 is disposed over substrate 106, and grid layer 112 is disposed over insulating layer 110. Insulating layer 110 defines a plurality of void regions 114, and each emitter 108 is disposed over substrate 106 in one of the void regions 114. Grid layer 112 defines a plurality of apertures 116. Each aperture 116 corresponds to, and overlies, one of the void regions 114. The apertures 116 are positioned so that (1) the grid layer 112 does not obstruct a path 117 between the upper tips of the emitters 108 and the faceplate 104 and (2) a portion of the grid layer 112 is proximal to the tip of each emitter 108. The grid layer 112 is normally configured as a plurality of conductive column lines and the baseplate 102 also includes a plurality of conductive row lines 118 disposed between emitters 108 and substrate 106.

Faceplate 104 includes a glass plate 120, a transparent conductor 122; and a phosphor layer 124. Transparent conductor 122 is disposed on one major surface of glass plate 120, and phosphor layer 124 is disposed on transparent conductor 122. The faceplate 104 and baseplate 102 are spaced apart from one another and are disposed so that the phosphor layer 124 is proximal to the grid layer 112.

FED 100 also includes a plurality of spacers 130 disposed between the faceplate 104 and baseplate 102. The spacers 130 maintain the orientation between baseplate 102 and faceplate 104 so that the baseplate and faceplate are substantially parallel to one another. Outer walls (not shown) seal the outer periphery of FED 100 and the space between baseplate 102 and faceplate 104 is substantially evacuated (creating a vacuum of about $10^{-2}$ to $10^{-9}$ Torr). Since the space between faceplate 104 and baseplate 102 is substantially evacuated, atmospheric pressure tends to press baseplate 102 and faceplate 104 together. However, spacers 130 resist this pressure and maintain the spacing between baseplate 102 and faceplate 104.

FED 100 also includes a power supply 140 for (1) charging the transparent conductor 122 to a highly positive voltage (e.g., 3,500 Volts); (2) selectively charging selective ones of the column lines of the grid layer 112 to a positive voltage (e.g., 40 Volts); and (3) selectively charging selective ones of the row lines 118 to a negative voltage (e.g., −40 Volts).

In operation, voltages applied to the row lines 118, the grid layer 112, and the transparent conductor 122 cause emitters 108 to emit electrons 150 that travel along path 117 towards, and impact on, phosphor layer 124. Incident electrons 150 on phosphor layer 124 cause phosphor layer 124 to emit photons and thereby generate a visible display on faceplate 104.

The visible display of FED 100 is normally arranged as a matrix of pixels. Each pixel in the display is typically associated with a group of emitters 108, with all the emitters 108 in a group being dedicated to controlling the brightness of their associated pixel. For example, FIG. 1 shows a single pixel 160, with pixel 160 being associated with emitters 108*a*, 108*b*, 108*c*, and 108*d*. Pixel 160 could be a single pixel of a black and white display or a single red, green, or blue dot associated with a single pixel of a color display. Charging line 118*a* to a negative voltage simultaneously activates emitters 108*a–d* causing emitters 108*a–d* to emit electrons that travel towards and impact on phosphor layer 124 in the region of pixel 160. Normally, the row and column lines are arranged so that the emitters associated with one pixel can be controlled independently of all other emitters in the display and so that all emitters associated with a single pixel are controlled in unison. For convenience of illustration, FIG. 1 shows four emitters as being associated with a single pixel 160, however, a two dimensional array of about 2,000 emitters is normally associated with each pixel of an FED.

Ideally, the spacers 130 have several important characteristics. First, it is important for the cross section of the spacers 130 to be relatively small compared with the area of each pixel. Ideally, the spacers 130 are characterized by a relatively high aspect ratio (i.e., the spacer's height is larger than its width). Typically, spacers 130 are about 200 to 2,000 microns high and about 25 microns wide. Such a high aspect ratio (1) provides sufficient spacing between the baseplate 102 and faceplate 104 to permit electrons traveling from emitters 108 towards faceplate 102 to acquire sufficient energy to cause phosphor layer 124 to emit photons and (2) minimizes the likelihood that electrons emitted by the emitters will be intercepted by the spacers rather than impacting the phosphor layer and thereby minimizes any effect that the spacers may have on the brightness of the display. The spacers 130 must also provide sufficient structural strength to resist the atmospheric pressure and thereby maintain the desired spacing between baseplate 102 and faceplate 104. It is also desirable for all spacers 130 to have the same height so they can provide uniform spacing between the baseplate 102 and the faceplate 104. It is also important for the spacers to be properly aligned with respect to the array of pixels so that dark regions in the display created where the spacers 130 contact the faceplate do not interfere with the display (e.g., it is desirable for the bottom of the spacers 130 to contact the grid layer 112 at selected locations that are between the apertures 116 and are equidistant from all the adjacent emitters). Since the spacers 130 are disposed within a vacuum, it is also important for the spacers to be formed from a vacuum compatible material (e.g., a material that does not outgas significantly).

The above-referenced '327 patent discloses a method of using photolithography to form the spacers for an FED. More specifically, the '327 patent discloses (1) disposing a layer of photosensitive polyimide over a baseplate (e.g., such as baseplate 102 as shown in FIG. 1); (2) disposing a mask between a radiation source and the polyimide layer, (3) exposing the masked polyimide layer to radiation; and (4) rinsing the exposed polyimide layer with an appropriate developer solution. The disclosed process "patterns" the polyimide layer or transforms the polyimide layer into a plurality of posts. Following a vacuum baking, the posts may be used as spacers in an FED. The spacers disclosed by the '327 patent suffer from several disadvantages. For example, polyimide is not an ideal photosensitive material. Also, polyimide is not an ideal material for use as a spacer in an FED.

In traditional photolithography, photoresist has been used to form only relatively thin features (e.g., one micron in height). However, recent work in the development of Micro Electro-Mechanical Systems (MEMS) has led to development of photoresists that can be used to form high aspect features. One such popular photoresist is known commercially as "SU-8". SU-8 comprises bisphenol, which is an a/novolac epoxy resin, and is manufactured by Shell Chemical. Guérin et al. suggested in "SU-8 photoepoxy: A new material for FDP and PDP applications" (L. J. Guérin, C. W. Newquist, H. Lorenz, Ph. Renaud, Institute for Microsystems, Swiss Federal Institute of Technology) that photoresist could be used to form high aspect posts, however, such posts do not have the necessary structural strength for forming spacers in FEDs. Also, such posts are likely to outgas significant amounts of gas and are therefore not suitable for use in a vacuum environment. It would therefore be desirable to develop techniques for using photoresist to form posts that (1) are vacuum compatible, (2) have a high aspect ratio, and (3) provide sufficient structural strength to operate as spacers in a FED.

SUMMARY OF THE INVENTION

These and other objects are provided by an improved method for forming spacers in an FED. In one aspect of the invention, the method uses photoresist as a mold for forming spacers in an FED. Photolithographic techniques permit the photoresist mold to be precisely positioned with respect to other elements of the FED.

In one aspect of the invention, a layer of photoresist is used to form an array of high aspect photoresist posts. These posts are not suitable for use as spacers themselves, but they can be used according to the invention as a mold for forming the spacers. The posts are then coated with a layer of coating material (e.g., silicon oxide or silicon nitride). This forms an array of high aspect columns of the coating material. The high aspect columns may then be further treated (e.g., the posts of photoresist material may be removed) to form spacers for use in an FED. Such spacers are vacuum compatible (i.e., the coating material does not outgas significantly), are structurally strong, and can be accurately located so as not to degrade the quality of the display.

In another aspect, the photoresist posts may be treated with silicon, so that the silicon penetrates into the photoresist posts, and then exposed to reactive oxygen so that the oxygen and silicon react to form a coating of silicon oxide around the posts. Such posts may also be used as spacers in an FED.

In still another aspect, the invention provides an FED in which the spacers are formed as columns of coating material.

Still other objects and advantages of the present invention will become readily apparent to those skilled in the art from the following detailed description wherein several embodiments are shown and described, simply by way of illustration of the best mode of the invention. As will be realized, the invention is capable of other and different embodiments, and its several details are capable of modifications in various respects, all without departing from the invention. Accordingly, the drawings and description are to be regarded as illustrative in nature, and not in a restrictive or limiting sense, with the scope of the application being indicated in the claims.

BRIEF DESCRIPTION OF THE FIGURES

For a fuller understanding of the nature and objects of the present invention, reference should be made to the following detailed description taken in connection with the accompanying drawings in which the same reference numerals are used to indicate the same or similar parts wherein.

DETAILED DESCRIPTION OF THE PREFERRED EMBODIMENTS

Figure 1:
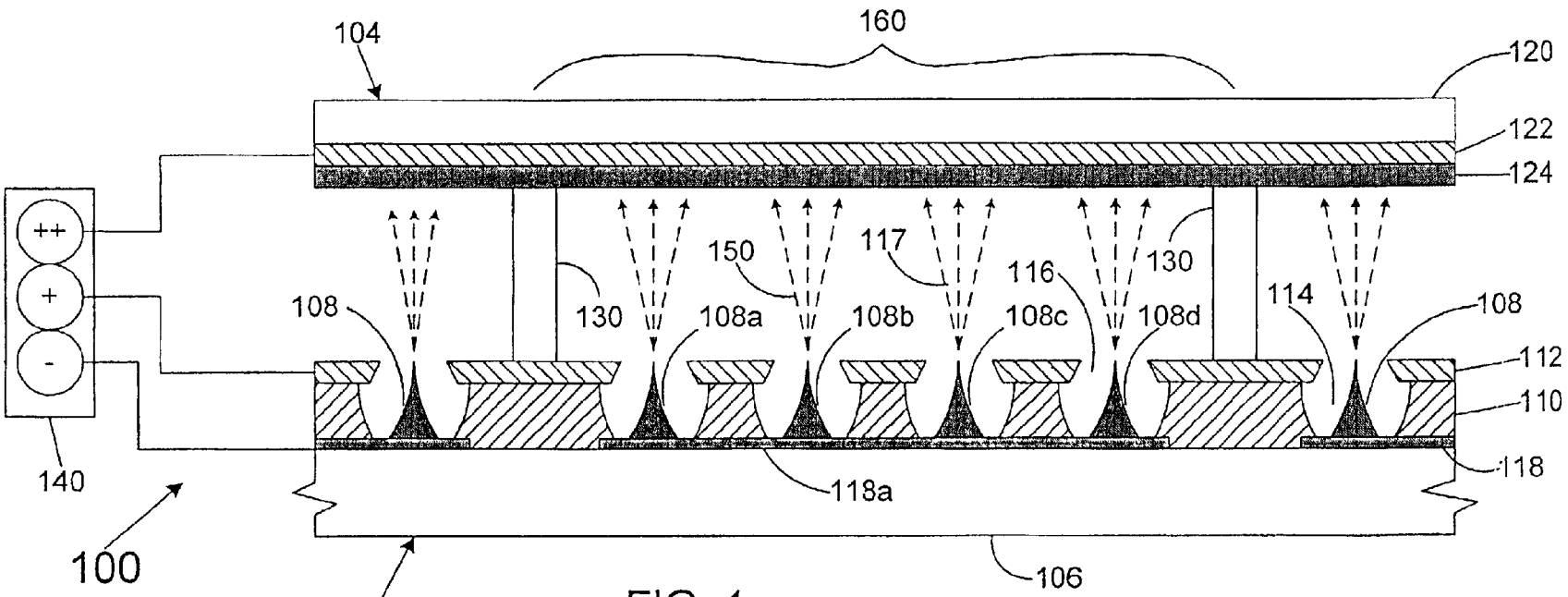
FIG. 1 Prior Art
FIG. 1 shows a cross sectional view of a portion of a prior art FED.
Figure 2:
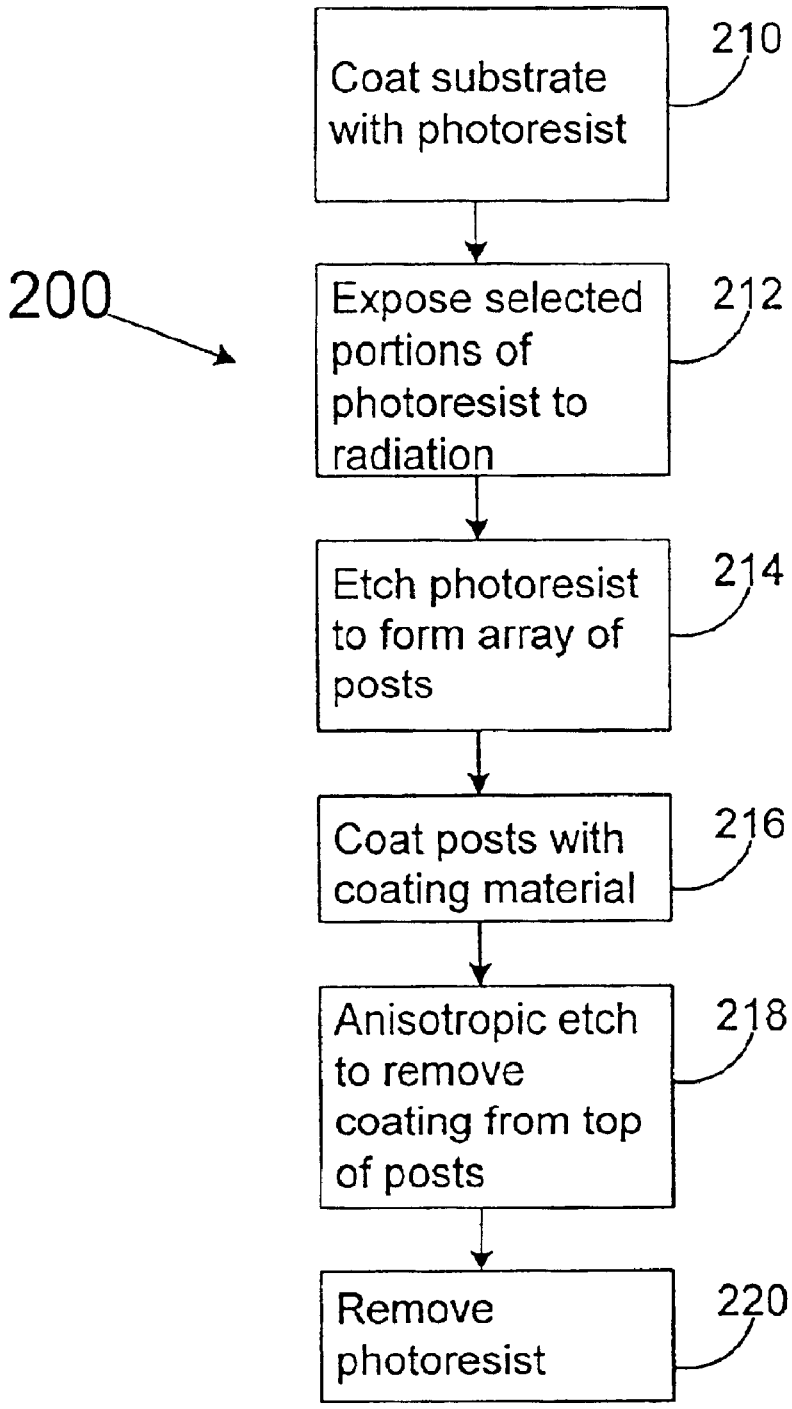
FIG. 2 shows a flow chart of a method according to the invention for forming spacers in an FED.
Figure 3A:
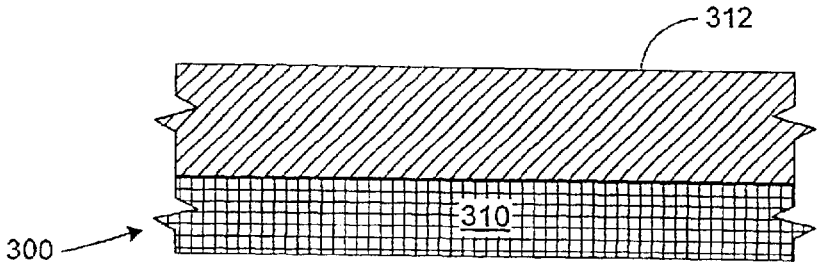
FIGS. 3A, 3B, 3C, 3D, and 3F show cross sectional views of structures formed at various steps in the method shown in FIG. 2.

FIG. 2 shows a flow chart of a method 200 according to the invention for constructing improved spacers for use in FEDs. FIGS. 3A–3G illustrate examples of the structures formed according to the invention at various steps of the method 200. Step 210 is the first step in method 200 and FIG. 3A shows the structure 300 formed after completion of step 210. The structure 300 includes a substrate 310 and a layer of photoresist 312 that is formed over the substrate 310. The layer of photoresist 312 preferably comprises a layer of SU-8 type photoresist. As will become clearer from the description below, the photoresist 312 is used to form spacers in a FED. Although the substrate 310 could comprise any surface, the substrate 310 typically comprises the baseplate of an FED (e.g., such as baseplate 102 as shown in FIG. 1). Further, the upper portion of the substrate 310 that contacts the photoresist 312 could comprise the grid layer of the FED s baseplate (e.g., such as grid layer 112 as shown in FIG. 1).

Following step 210, step 212 is performed in which selected portions of the photoresist are exposed to radiation. This step is performed in accordance with conventional photolithography. Normally, a patterned photographic mask is positioned between the photoresist and a radiation source. When the radiation source is activated, apertures in the mask allow emitted radiation to illuminate portions of the photoresist while the remainder of the mask casts a shadow on the rest of the photoresist. Incident radiation affects the illuminated portion of the photoresist making the illuminated portions more (in a positive working photoresist) or less (in a negative working photoresist) susceptible to etching by certain chemical etchants. The invention discussed herein may be used with either positive or negative working photoresists. Following radiation exposure, in step 214 the photoresist is exposed to an appropriate chemical etchant. In the case of a positive working photoresist, the etchant removes the portions of the photoresist that were exposed to the radiation and in the case of a negative working photoresist, the etchant removes the portions of the photoresist that were shielded from exposure to the radiation.

Figure 3B:
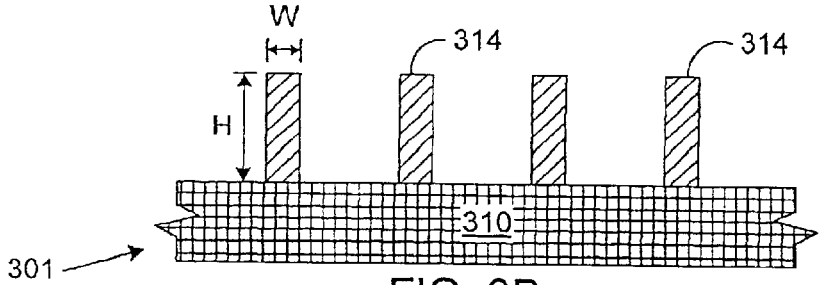

FIG. 3B shows a cross sectional view of structure 301 formed after completion of step 214. As shown, unwanted portions of the photoresist 312 have been removed so that structure 301 includes a plurality of high aspect posts 314 (each post 314 being made of unetched, or cured, photoresist) disposed over the substrate 310. As discussed below, each post 314 will be used to form a single spacer in a FED (e.g., such as spacer 130 as shown in FIG. 1). For convenience of illustration, FIG. 3B shows four posts 314 disposed above substrate 310, however, many more posts are normally formed. Since photoresist lacks the desired structural characteristics for FEDs (i.e., it is not strong enough and is not vacuum compatible), the posts 314 are not used as spacers themselves, however, as discussed below, they can be used according to the invention to form suitable spacers. In one embodiment, the height H of the posts is substantially equal to 1000 microns and the width W of the posts is substantially equal to 20 microns.

Figure 3C:
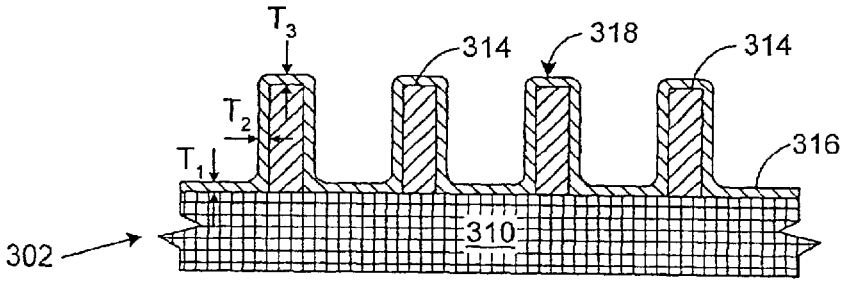

Following step 214, step 216 is performed in which a layer of coating material is formed on the substrate and posts. FIG. 3C shows a cross sectional view of the structure 302 formed after completion of step 216 in which a layer of coating material 316 covers the top of substrate 310 and also covers the top and sides of posts 314. Each post 314 of photoresist and the coating material 316 that coats the top and sides of the post 314 together form a column 318. Preferably, coating material 316 is a vacuum compatible material that possesses sufficient structural strength for use as a spacer in a FED. Silicon oxide and silicon nitride are examples of materials suitable for use as coating material 316. Other suitable materials include silicon monoxide, glasses, ceramics and resistive semiconductors. In one embodiment, the layer of coating material 316 is a layer of silicon oxide, the thickness $T_1$ of the portion of layer 316 disposed over the substrate 310 is substantially equal to 3 microns, the thickness $T_2$ of the portion of layer 316 coating the sides of posts 314 is substantially equal to 2 microns and the thickness $T_3$ of the portion of layer 316 coating the tops of the posts 314 is substantially equal to 3 microns. Suitable methods for forming the layer of coating material 316 include chemical vapor deposition, plasma enhanced chemical vapor deposition, conventional thin-film deposition techniques.

Figure 3D:
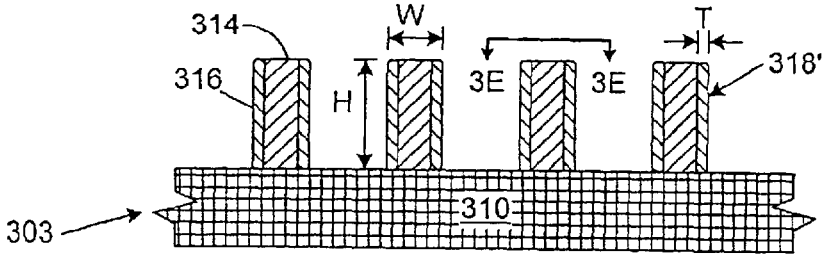
Figure 3E:
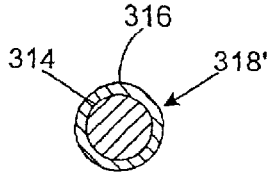
FIG. 3E shows a top view of one of the columns shown in FIG. 3D.

Following step 216, step 218 is performed in which the coating material is subjected to an anisotropic etch that etches substantially faster in the vertical direction than in the horizontal direction. In the field of FEDs, this type of anisotropic etch may be performed by using a reactive gas plasma between 0 and 10 Torr pressure in parallel with directional ion bombardment of substrate 310. In the case where layer 316 is $SiO_2$ a flourine containing chemistry may be used. FIG. 3D shows a cross sectional view of the structure 303 formed after completion of step 218 in which the coating material 316 has been substantially removed from the upper horizontal surface of substrate 310 and from the horizontal top surface of the posts 314. However, a layer of the coating material 316 remains along the sides of the posts 314 and forms sidewalls that surround each of the posts 314. At this point, each post 314 of photoresist and the sidewall of coating material 316 along the sides of the post together form a column 318'. FIG. 3E shows a top view of one of the columns 318'. In the embodiment illustrated in FIG. 3E, the columns 318' have a circular cross section. However, the columns 318' could be formed with square, rectangular, oval, or other shaped cross sections.

Figure 3F:
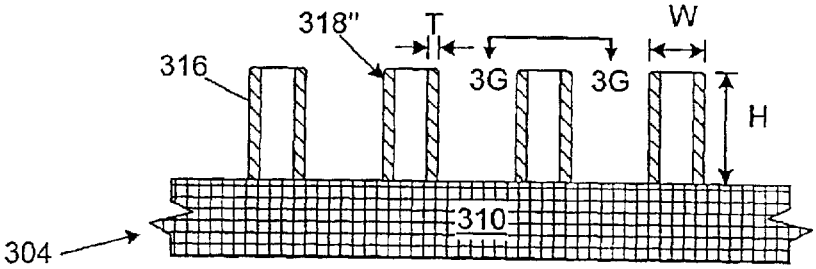
Figure 3G:
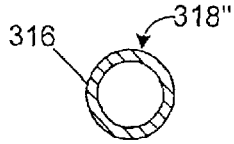
FIG. 3G shows a top view of one of the columns shown in FIG. 3F.

Following step 218, step 220 is performed in which the columns are subjected to an etch that removes the cured photoresist posts 314. FIG. 3F shows a cross sectional view of the structure 304 formed after completion of step 220. As shown, in structure 304 the posts of photoresist 314 have been removed leaving the vertical sidewalls of coating material 316 disposed over substrate 310. Each vertical sidewall of coating material 316 forms a column 318" and FIG. 3G shows a top view of one of the columns 318". In one embodiment, the coating layer 316 used to form each column 318" is silicon oxide, the width W of each column 318" is substantially equal to 24 microns, the height of each column 318" is substantially equal to 1000 microns, and the thickness T of each column sidewall is substantially equal to 2 microns. The height H of the columns 318" is preferably at least 8 times as large as the width W, and is more preferably 80 times as large. As shown in FIGS. 3F and 3G, the columns 318" are formed in the shape of hollow tubes. The tubes are shown as having circular cross sections, but as discussed above, the tubes could be formed with other shaped cross sections (e.g., square).

In one embodiment of the invention, the columns 318" (for example as shown in FIGS. 3F and 3G) are then used as spacers in a field emission display (e.g., such as spacers 130 as shown in FIG. 1). In this embodiment, the substrate 310 normally forms the baseplate of the FED, and after formation of the columns 318", the faceplate is fitted over the columns 318".

The photoresist 314 essentially acts as a mold permitting formation of the high aspect columns 318". The use of photolithography to form the columns 318" as described herein (1) advantageously allows the columns to be located on the substrate 310 with a high degree of precision (e.g., to position each column 318" equidistant from each adjacent emitter) and (2) advantageously insures that the heights of all the columns 318" will be substantially equal (since all the photoresist posts used to form the columns 318" are formed from a single layer of material, it is easy to insure that the heights of all the posts, and therefore the heights of all the resulting columns 318", are substantially equal). Also, the coating material 316 (e.g., silicon oxide) used to form the columns 318" (1) is a vacuum compatible material and will not outgas significantly and therefore will not disturb the vacuum between the faceplate and the baseplate and (2) possesses sufficient structural strength to maintain the spacing between the faceplate and the baseplate of the FED.

In other embodiments some steps of method 200 may be eliminated. For example, rather than forming columns 318" (as shown in FIGS. 3F and 3G), columns 318 (as shown in FIG. 3C) could be used as spacers in an FED. Since the coating layer 316 completely covers the photoresist posts 314, the coating layer prevents any outgassing of the photoresist posts from disturbing the vacuum between the faceplate and the baseplate. When columns 318 are used as spacers in an FED, it may be desirable to thermally treat the posts 314 (as shown in FIG. 3B) prior to coating them with the layer of coating material 316. Such thermal treatment can (1) remove solvents from the photoresist posts 314 and (2) increase the density of the posts 314. One example of a useful thermal treatment is to bake the structure 301 (shown in FIG. 3B) at four hundred twenty five degrees Celsius for about three to four hours. In addition to removing solvents and increasing density, such thermal treatment also improves the quality of the subsequently deposited coating layer 316.

Figure 4:
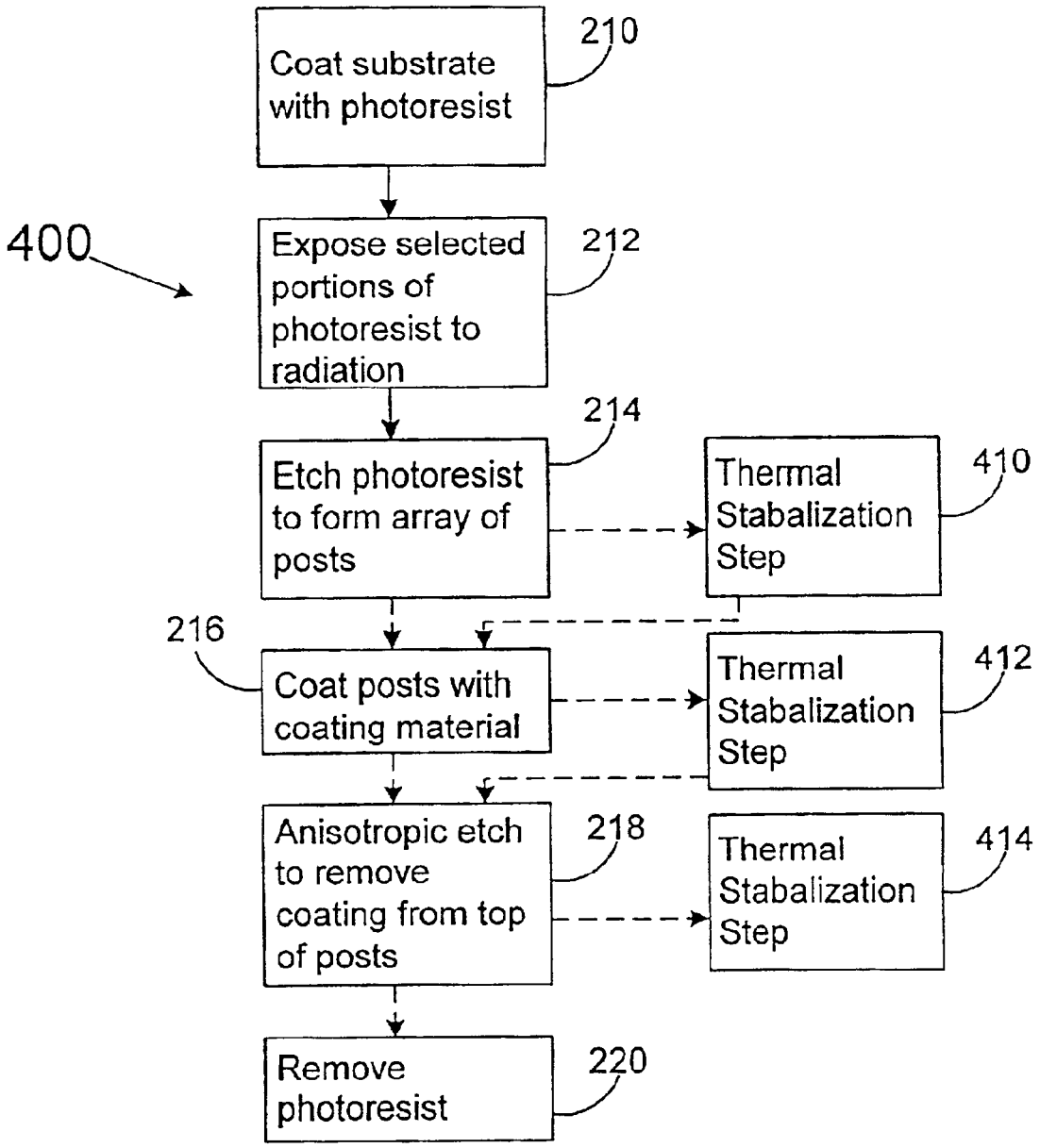
FIG. 4 shows a flow chart of alternate embodiments according to the invention of the method shown in FIG. 2.
Figure 5:
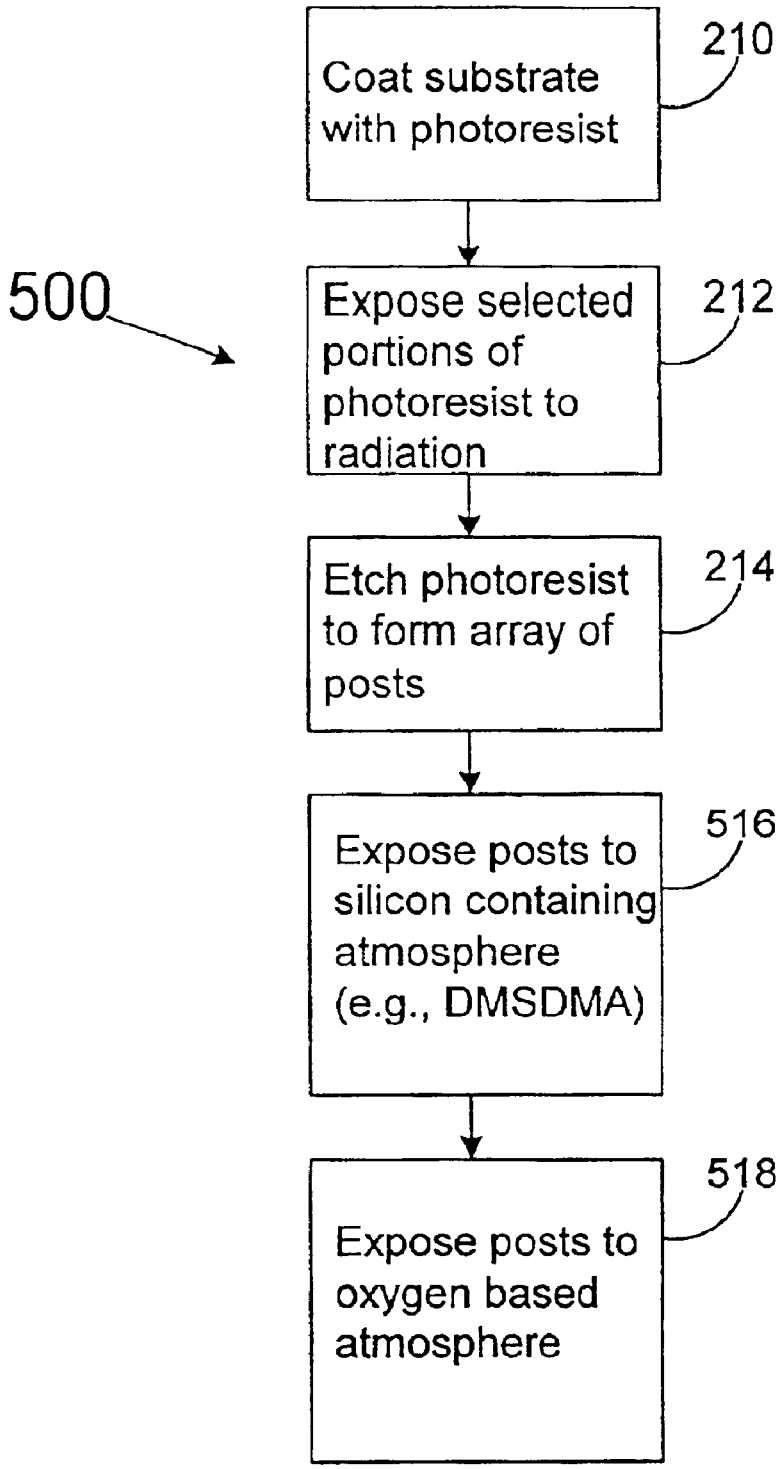
FIG. 5 shows a flow chart of another method according to the invention for forming spacers in an FED.

FIG. 4 illustrates other embodiments according to the invention of the method shown in FIG. 2. As shown in FIG. 4, a thermal treatment, or stabilization, step 410 may be added between steps 214 (photoresist etching) and 216 (coat with coating material). Alternatively, instead of including step 410, a similar thermal stabilization step 412 may be added after step 216. In either of these cases, the columns 318 (shown in FIG. 3C) may be used as spacers in an FED. In another variation, both thermal stabilization steps 410 (after step 214) and 412 (after step 216) are included and the thermally treated columns 318 are used as spacers in an FED. In yet another variation, a thermal stabilization step 414 may be included after step 218 (anisotropic etch). In this case, the columns 318' (FIG. 3D) are used as spacers in an FED. The thermal stabilization step 414 improves the vacuum compatibility (e.g., by removing solvents and thereby reducing outgassing) of the photoresist posts 314. When columns 318' (FIG. 3D) are used as spacers in an FED, any or all of the thermal stabilization steps 410, 412, and 414 may be included. In still another variation, the photoresist posts 314 (FIG. 3B) may themselves be used as spacers in an FED after they are treated with thermal stabilization step 410. Each of the thermal stabilization steps 410, 412, 414 preferably comprise baking at four hundred twenty five degrees Celsius for about three to four hours. Since the thermal treatment steps can also improve the quality of the coating layer 316, it may be advantageous to include one or more of the thermal treatment steps 410, 412, 414 in the process for forming columns 318" (FIG. 3F). Regardless of whether posts 314 (FIG. 3B), columns 318 (FIG. 3C), columns 318' (FIG. 3D) or columns 318" (FIG. 3F) are used as spacers in an FED, the height of the spacers is preferably at least 8 times as large as their width, and more preferably is 80 times as large. FIG. 5 shows a flow chart of another method 500 for forming spacers in an FED according to the invention. In method 500, a step 516 is executed after step 214. In step 516, the posts (e.g., posts 314 as shown in FIG. 3B) are exposed to a silicon containing atmosphere such as dimethylsilyldimethylamine (DMSDMA); e.g. in which silicon or a silicon containing compound in a gaseous condition contacts element 301. Preferably, the posts are so exposed until the silicon penetrates into the photoresist posts to a depth of about 1000 Angstroms or more. Preferred conditions for so exposing the posts include DMSDMA vapor at a temperature elevated above room temperature.

Following step 516, step 518 is performed in which the posts are exposed to reactive oxygen (e.g. by using oxygen feed gas to create a plasma in an environment with 13.56 MHz generation and below 10 Torr pressure.) Preferably, in this step the posts are exposed to an oxygen based plasma that includes reactive oxygen, atomic species. In this atmosphere, atoms of oxygen bond with the silicon that has previously penetrated into the photoresist posts and forms a silicon oxide coating around the photoresist posts. These coated posts may then be used as spacers in an FED. In variations on this embodiment, it may be advantageous to thermally treat (e.g., heat to about four hundred twenty five degrees Celsius for about three to four hours) the photoresist posts before, after, or both before and after, exposing them to reactive oxygen.

Since certain changes may be made in the above apparatus without departing from the scope of the invention herein involved, it is intended that all matter contained in the above description or shown in the accompanying drawing shall be interpreted in an illustrative and not a limiting sense.

What is claimed is:

1. A method of forming a field emission display, comprising:

forming a cathode, the cathode including a plurality of emitters;

forming a plurality of posts over the cathode, the posts comprising a photoresist material;

coating the posts with a coating material, the coating material forming sidewalls around the posts;

removing the photoresist material from within the sidewalls;

forming an anode and spacing the anode apart from the cathode, the sidewalls extending from the cathode to the anode.

2. A method according to claim 1, wherein the coating material comprises silicon oxide.

3. A method according to claim 1, wherein the coating material comprises silicon nitride.

4. A method according to claim 1, wherein forming the plurality of posts over the cathode comprises:

forming a layer of photoresist material over the cathode;

exposing selected portions of the photoresist material to radiation;

exposing the photoresist material to an etchant.

5. A method according to claim 1, wherein forming the cathode comprises:

forming an insulating layer over a substrate, the insulating layer defining a plurality of void regions;

forming a conductive grid layer over the insulating layer, the conductive grid layer defining a plurality of apertures, each one of the apertures corresponding to one of the void regions and each aperture overlying its corresponding void region;

forming the plurality of emitters over the substrate, each one of the emitters corresponding to one of the void regions and one of the apertures, each emitter being disposed within its corresponding void region.

6. A method according to claim 1, further comprising substantially evacuating the. space between the anode and cathode to form a vacuum between the anode and cathode, the sidewalls maintaining the spacing between the anode and the cathode.

7. A method according to claim 1, wherein coating the posts with the coating material comprises forming a layer of the coating material on a top of the posts, on a side of the posts, and on a top of the cathode.

8. A method according to claim 7, further comprising removing substantially all of the coating material from the top of the posts and from the top of the cathode.

9. A method according to claim 7, further comprising etching the coating material anisotropically.

10. A method according to claim 9, wherein etching the coating material anisotropically comprises etching the coating material faster in a vertical direction than in a horizontal direction.

11. A method according to claim 1, wherein a height of the sidewalls is at least 8 times greater than a width of the sidewalls.

12. A method according to claim 1, further comprising heating the posts prior to coating the posts with the coating material.

13. A method according to claim 1, further comprising heating the posts after coating the posts with the coating material.

14. A method of forming a field emission display, comprising:

forming a cathode, the cathode including a plurality of emitters;

forming a plurality of posts over the cathode, the posts comprising a photoresist material;

coating the posts with a coating material, each post and the coating material that coats that post forming a column;

removing the photoresist material from within the sidewalls; and forming an anode and spacing the anode apart from the cathode, the columns extending from the cathode to the anode.

15. A method according to claim 14, wherein the coating material comprises silicon oxide.

16. A method according to claim 14, wherein the coating material comprises silicon nitride.

17. A method according to claim 14, wherein forming the plurality of posts over the cathode comprises:

forming a layer of photoresist material over the cathode;

exposing selected portions of the photoresist material to radiation;

exposing the photoresist material to an etchant.

18. A method according to claim 14, wherein forming the cathode comprises:

forming an insulating layer over a substrate, the insulating layer defining a plurality of void regions;

forming a conductive grid layer over the insulating layer, the conductive grid layer defining a plurality of apertures, each one of the apertures corresponding to one of the void regions and each aperture overlying its corresponding void region;

forming the plurality of emitters over the substrate, each one of the emitters corresponding to one of the void regions and one of the apertures, each emitter being disposed within its corresponding void region.

19. A method according to claim 14, further comprising substantially evacuating the space between the anode and cathode to form a vacuum between the anode and cathode, the columns maintaining the spacing between the anode and the cathode.

20. A method according to claim 14, wherein coating the posts with the coating material comprises forming a layer of the coating material on a top of the posts, on a side of the posts, and on a top of the cathode.

21. A method according to claim 20, further comprising removing substantially all of the coating material from the top of the posts and from the top of the cathode.

22. A method according to claim 21, further comprising heating the posts after removing substantially all of the coating material from the top of the posts.

23. A method according to claim 20, further comprising etching the coating material anisotropically.

24. A method according to claim 23, wherein etching the coating material anisotropically comprises etching the coating material faster in a vertical direction than in a horizontal direction.

25. A method according to claim 14, wherein a height of the columns is at least 8 times greater than a width of the columns.

26. A method according to claim 14, further comprising heating the posts prior to coating the posts with the coating material.

27. A method according to claim 14, further comprising heating the posts after coating the posts with the coating material.

28. A method of forming a field emission display, comprising:

forming a cathode, the cathode including a plurality of emitters;

forming a plurality of posts over the cathode, the posts comprising a photoresist material;

exposing the posts to an atmosphere comprising silicon;

exposing the posts to reactive oxygen;

removing the photoresist material from within the sidewalls; and forming an anode and spacing the anode apart from the cathode, the posts extending from the cathode to the anode.

29. A method according to claim 28, wherein forming the plurality of posts over the cathode comprises:

forming a layer of photoresist material over the cathode;

exposing selected portions of the photoresist material to radiation;

exposing the photoresist material to an etchant.

30. A method according to claim 28, wherein forming the cathode comprises:

forming an insulating layer over a substrate, the insulating layer defining a plurality of void regions;

forming a conductive grid layer over the insulating layer, the conductive grid layer defining a plurality of apertures, each one of the apertures corresponding to one of the void regions and each aperture overlying its corresponding void region;

forming the plurality of emitters over the substrate, each one of the emitters corresponding to one of the void regions and one of the apertures, each emitter being disposed within its corresponding void region.

31. A method according to claim 28, further comprising substantially evacuating the space between the anode and cathode to form a vacuum between the anode and cathode, the posts maintaining the spacing between the anode and the cathode.

32. A method according to claim 28, wherein a height of the posts is at least 8 times greater than a width of the posts.

33. A method according to claim 28, further comprising heating the posts after exposing the posts to reactive oxygen.

34. A method of forming a field emission display, comprising:

forming an insulating layer over a substrate, the insulating layer defining a plurality of void regions;

forming a conductive grid layer over the insulating layer, the conductive grid layer defining a plurality of apertures, each one of the apertures corresponding to one of the void regions and each aperture overlying its corresponding void region;

forming a plurality of emitters over the substrate, each one of the emitters corresponding to one of the void regions and one of the apertures, each emitter being disposed within its corresponding void region;

forming a plurality of posts over the grid layer, the posts comprising a photoresist material;

coating the posts with a coating material, the coating material forming sidewalls around the posts;

removing the photoresist material from within the sidewalls;

disposing a faceplate opposite the grid layer, the sidewalls extending from the grid layer to the faceplate.

35. A method of forming a field emission display, comprising:

forming an insulating layer over a substrate, the insulating layer defining a plurality of void regions;

forming a conductive grid layer over the insulating layer, the conductive grid layer defining a plurality of apertures, each one of the apertures corresponding to one of the void regions and each aperture overlying its corresponding void region;

forming a plurality of emitters over the substrate, each one of the emitters corresponding to one of the void regions and one of the apertures, each emitter being disposed within its corresponding void region;

forming a plurality of posts over the grid layer, the posts comprising a photoresist material;

coating the posts with a coating material, each post and the coating material that coats that post forming a column;

removing the photoresist material from within the sidewalls; and disposing a faceplate opposite the grid layer, the columns extending from the grid layer to the faceplate.

36. A method of forming a field emission display, comprising:

forming an insulating layer over a substrate, the insulating layer defining a plurality of void regions;

forming a conductive grid layer over the insulating layer, the conductive grid layer defining a plurality of apertures, each one of the apertures corresponding to one of the void regions and each aperture overlying its corresponding void region;

forming a plurality of emitters over the substrate, each one of the emitters corresponding to one of the void regions and one of the apertures, each emitter being disposed within its corresponding void region;

forming a plurality of posts over the grid layer, the posts comprising a photoresist material;

exposing the posts to an atmosphere comprising silicon;

exposing the posts to reactive oxygen;

removing the photoresist material from within the sidewalls; and disposing a faceplate opposite the grid layer, the posts extending from the grid layer to the faceplate.

37. A method of forming a spacer for use in a field emission display, comprising:

forming a plurality of posts over a substrate, the posts comprising a photoresist material;

coating the posts with a coating material, the coating material forming sidewalls around the posts;

removing the photoresist material from within the sidewalls.

38. A method according to claim 37, wherein the coating material comprises silicon oxide.

39. A method according to claim 37, wherein the coating material comprises silicon nitride.

40. A method according to claim 37, wherein a height of the sidewalls is at least 8 times greater than a width of the sidewalls.

41. A method of forming a spacer for use in a field emission display, comprising:

forming a plurality of posts over a substrate, the posts comprising a photoresist material;

coating the posts with a coating material, each post and the coating material that coats that post forming a column; and removing the photoresist material from within the sidewalls.

42. A method according to claim 41, wherein the coating material comprises silicon oxide.

43. A method according to claim 41, wherein the coating material comprises silicon nitride.

44. A method according to claim 41, wherein a height of the posts is at least 8 times greater than a width of the posts.

* * * * *